US006179411B1

(12) United States Patent
Saikawa et al.

(10) Patent No.: US 6,179,411 B1
(45) Date of Patent: Jan. 30, 2001

(54) INK JET RECORDING HEAD AND AN INK JET RECORDING APPARATUS

(75) Inventors: Hideo Saikawa, Machida; Ryoji Inoue, Kawasaki, both of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/149,278

(22) Filed: Sep. 9, 1998

(30) Foreign Application Priority Data

Sep. 11, 1997 (JP) ..... 9-246889
Aug. 28, 1998 (JP) ..... 10-243534

(51) Int. Cl.[7] ..... B41J 2/14; B41J 2/05
(52) U.S. Cl. ..... 347/48; 347/65
(58) Field of Search ..... 347/56, 57, 62, 347/64, 48, 65, 63

(56) References Cited

U.S. PATENT DOCUMENTS 4,251,824 * 2/1981 Hara et al. ..... 347/57
5,262,802 11/1993 Karita et al. ..... 346/140 R
5,481,287 * 1/1996 Tachihara ..... 347/62
5,754,201 * 5/1998 Ishinaga et al. ..... 347/62

FOREIGN PATENT DOCUMENTS 55-132259 10/1980 (JP) .
1-242258 * 9/1989 (JP) .
3-15559 1/1991 (JP) .
6-316078 11/1994 (JP) .
8-332727 12/1996 (JP) .

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

An ink jet recording head comprises a discharge port for discharging ink, two electrothermal converting elements for generating thermal energy utilized for discharging the ink, and an ink flow path provided with the two electrothermal converting elements, at the same time, being conductively connected with the discharge port, and this head has a first discharge mode for discharging liquid droplets from the discharge port when the electrothermal converting element on the side nearer to the discharge port, of the two electrothermal converting elements, receives driving signals to generate the thermal energy, and also, a second discharge mode for discharging liquid droplets from the discharge port in the larger discharge amount than that of the first mode when both of the two electrothermal converting elements receive driving signals to generate the thermal energy. Then, of the two electrothermal converting elements, the length of the electrothermal converting element on the side farther away from the discharge port in the ink discharge direction is made shorter than that of the other electrothermal converting element. With the ink jet recording head thus structured, it is possible to perform higher speed printing in higher image quality and higher gradation.

9 Claims, 10 Drawing Sheets

INK JET RECORDING HEAD AND AN INK JET RECORDING APPARATUS

BACKGROUND OF THE INVENTION

1. Field of the Invention

The present invention relates to an ink jet recording apparatus. More particularly, the invention relates to an ink jet recording apparatus of the on-demand type where characters and images are recorded by discharging ink only when recording is needed. Also, the present invention is not only applicable to the printing on paper sheets used in the office, but also, applicable to the industrial apparatus that records on all the media serving as ink supporting elements that accept the provision of ink, such as cloths, threads, sheets, among some others.

2. Related Background Art

The ink jet recording method, in which recording is made by discharging a desired liquid by means of bubbles created by the application of thermal energy that acts upon the liquid has excellent advantages that by use of a smaller apparatus, high resolution images can be recorded in colors at high speeds with a lesser amount of noises. Therefore, in recent years, the ink jet recording method has been widely utilized for a printer, a copying machine, a facsimile equipment, and many other office equipment. Further, this method has begun to be used for a textile printing system and other systems for the industrial use.

Along with the wider utilization of the ink jet recording technologies and techniques for the products in many fields, there are more demands in the provision of higher gradation, and higher image quality as well.

As one of the methods to materialize the higher gradation and higher image quality, there is a dither method and other pseudo multi-value recording methods. The recording head that adopts any one of these methods has a high nozzle density with a smaller volume of each droplet so as to form an image with more numbers of dots. However, with such method, the discharge frequency of droplets per recording sheet should be increased. As a result, the life of head becomes shorter. Also, with the higher density of nozzle of the recording head, there is a problem, among some others, that the costs of head manufacture are increased accordingly.

Now, therefore, there has been proposed a structure in which two or more electrothermal converting elements are provided for one nozzle each as disclosed in the specifications of Japanese Patent Laid-Open Application No. 55-132259, and Japanese Patent Laid-Open Application No. 08-332727. More specifically, with the two electrothermal converting elements arranged for one nozzle, two of them are driven at a time to obtain a droplet having a larger discharge amount (a large droplet), while driving either one of the electrothermal converting elements to obtain a droplet having a smaller discharge amount (a small droplet), thus changing the amounts of discharges. In this way, without changing the nozzle density from those conventionally in use, the amount of discharges can be changed with an extremely simple structure for the implementation of the higher gradation and higher image quality.

For the recording head that adopts the method in which a plurality of electrothermal converting elements are arranged for one nozzle, and the driving modes are changed in accordance with the amount of liquid to be discharged, it is still possible to utilize the conventional apparatus for manufacturing the recording heads for the implementation of the lower cost production.

However, in addition to the demands on still higher gradation and image quality as described above, there is a demand on the further enhancement of printing speeds of the ink jet recording method. In order to print at higher speeds, the electrothermal converting elements should be driven at higher frequency.

Here, one of the factors that may hinder the higher speed printing is the temperature rise of the head. For an ink jet recording head, approximately a 30% of given energy is used for discharging ink, but almost the entire remainders are changed into thermal energy to cause the head temperature to rise eventually. As a result, the higher the head driving, the more the head temperature rises. This may cause the instability of the discharge condition of droplets.

Now, in this respect, a method has been proposed in which the thickness of the protection film of the electrothermal converting element is made thinner so that the rise of the heat temperature is suppressed, while it is made possible to improve the foaming efficiency. FIG. 10A is a plan view which illustrates the method thus proposed. In FIG. 10A, an electrothermal converting element 53 is arranged in the nozzle 109. Also, FIG. 10B is a cross-sectional view which schematically shows the structure of the electrothermal converting element, taken along line 10B —10B in FIG. 10A. In FIG. 10B, a reference numeral 71 designates a silicon substrate on which are arranged among some others, the resistance layer 72 formed by HfB2 or other resistance material; the AL wiring layer 73; the lower layer 75 of the protection film formed by PSG or other insulation material; and the upper layer 76 of the protection film formed by $SiO_2$ or other insulation material. Only the portion of the electrothermal converting element of the lower layer 75 of the protection film is removed by means of etching so as to make the protection layer thinner by 0.6 $\mu$m corresponding to the thickness of the lower layer 75 of the protection film. In this way, the heat transferability becomes better so as to enhance the foaming efficiency. With the structure described above, the amount of energy that changes into heat is absorbed by the protection film, thus suppressing the temperature rise of the recording head.

Meanwhile, the major factor other than the thermal characteristics is the time required for refilling liquid from the rear end of the nozzle in an amount equivalent to the liquid droplet that has been discharged from the discharge port. Particularly, for the head capable of modulating discharge amounts, which is structured with two electrothermal converting elements in one nozzle, it is an important key to the attainment of the higher printing that the refilling time of the larger droplet should be made shorter rather than dealing with that of the smaller droplet. In consideration of the variation of discharge amounts, it is desirable to make the amount of the smaller droplet as smaller as possible with respect to that of the larger droplet in practical use (for example, a smaller droplet is 10 to 15 pl against a larger droplet of 40 pl) for the purpose of improving the gradation. Naturally, therefore, the amount of liquid that should be refilled is smaller for the smaller droplet as compared with the case where the amount equivalent to the larger droplet should be refilled.

Now, the inventors hereof have given attention to the positions of the two electrothermal converting elements which are arranged centering on the foaming of the larger droplets, and then, devised the invention taken out herein so as to attempt shorting the refilling time, while maintaining the freedom of nozzle designs to make the conventional nozzle manufacturing apparatus still applicable to the manufacture of new heads.

SUMMARY OF THE INVENTION

In other words, on the premise that the recording head is arranged to modulate discharge amounts with the provision of two electrothermal converting elements in one nozzle as described above, the present invention is designed to aim at the provision of a recording head capable of presenting higher image quality and higher gradation at higher speeds by making the refilling time of larger droplets shorter, as well as to aim at the provision of a recording apparatus using such head.

The ink jet recording head of the present invention comprises a discharge port for discharging ink; two electrothermal converting elements for generating thermal energy utilized for discharging the ink; and an ink flow path provided with the two electrothermal converting elements, at the same time, being conductively connected with the discharge port, and this head has a first discharge mode for discharging liquid droplets from the discharge port when the electrothermal converting element on the side nearer to the discharge port, of the two electrothermal converting elements, receives driving signals to generate the thermal energy, and also, a second discharge mode for discharging liquid droplets from the discharge port in the larger discharge amount than that of the first mode when both of the two electrothermal converting elements receive driving signals to generate the thermal energy. Then, of the two electrothermal converting elements, the length of the electrothermal converting element on the side farther away from the discharge port in the ink discharge direction is made shorter than that of the other electrothermal converting element.

In other words, with the structure arranged as above in accordance with the present invention, the foaming center of the larger droplet (the gravitational position of the two electrothermal converting elements that may function as one electrothermal converting element) is positioned further backward from the central portion of the two electrothermal converting elements arranged to be functional as if one large electrothermal converting element (on the upstream side in the ink supply direction). As a result, the foaming center is allowed to shift further backward (to the side opposite to the orifice), hence reducing the flow resistance on the rear side of the foaming center to make it easier for ink to be refilled from the rear end of the nozzle. The refilling time is then made shorter.

Only with the structure described above, the present invention is able to solve the problems, which is the objectives of the invention, and to materialize recording in higher gradation and higher image quality at higher speeds. Here, it is also desirable to arrange the minimum applicable voltages required for the two electrothermal converting elements to be substantially equal for discharging ink for the reasons given below. In other words, although the minimum applicable voltage required for discharge becomes different in general if the length of the electrothermal converting element is made larger in the ink supply direction, it is possible to solve the problems related to the cost increase of the apparatus main body due to the provision of plural kinds of application circuits, which naturally brings about more complicated structure thereof, by preferably arranging the structure of the present invention so as to make the minimum applicable voltages substantially equal to the two electrothermal converting elements.

Here, specific means for making the minimum applicable voltages substantially equal is such as to arrange "the thickness of the protection film of the electrothermal converting element farther away from the orifice to be larger than that of the other electrothermal converting element", "the heat transferability of the protection film of the electrothermal converting element farther away from the orifice to be lower than that of the other electrothermal converting element" or the like.

In this way, it becomes possible to provide the ink jet recording head whereby to solve the above-mentioned problems and implement a higher speed printing in higher quality and higher gradation by making the refilling time shorter for the head capable of modulating discharge amounts.

Also, the ink jet recording apparatus of the present invention is arranged to comprise an ink jet recording head provided with a discharge port for discharging ink; two electrothermal converting elements for generating thermal energy utilized for discharging the ink; and an ink flow path provided with the two electrothermal converting elements, at the same time, being conductively connected with the discharge port;

and installation means for mounting the head. This ink jet recording apparatus has a first discharge mode for discharging liquid droplets from the discharge port when the electrothermal converting element on the side nearer to the discharge port, of the two electrothermal converting elements, receives driving signals to generate the thermal energy, and a second discharge mode for discharging liquid droplets from the discharge port in the larger discharge amount than that of the first mode when both of the two electrothermal converting elements receive driving signals to generate the thermal energy. Then, of the two electrothermal converting elements, the length of the electrothermal converting element on the side farther away from the discharge ports in the ink discharge direction is made shorter than that of the other electrothermal converting element. In this manner, the above-mentioned problems are solved, hence making it possible to provide the ink jet recording apparatus capable of printing at higher speeds in higher image quality and higher gradation.

In this respect, for the present invention, the phrase to the effect that "of the two electrothermal converting elements, the one on the side nearer to the discharge port" is meant to indicate the electrothermal converting element on the side nearer to the discharge port side (on the downstream side in the ink supply direction), that is, of the two electrothermal converting elements, the one whose rear edge (the farthest end thereof from the discharge port) is more on the front side, provided that the discharge port side is defined as the front side in the ink supply direction in the ink flow path.

BRIEF DESCRIPTION OF THE DRAWINGS

FIG. 2A is a detailed view of a nozzle; FIG. 2B is a cross-sectional view of an electrothermal converting element, taken along line 2B—2B in FIG. 2A; and FIG. 2C is a cross-sectional view of an electrothermal converting element, taken along line 2C—2C in FIG. 2A.

FIG. 3A shows the foaming state of a smaller droplet; and FIG. 3B shows that of a larger droplet.

FIG. 4A illustrates the foaming state of the first embodiment; FIG. 4B and FIG. 4C illustrate that of the comparison example.

FIG. 5A is the detailed view of a nozzle; and FIG. 5B is a cross-sectional view which shows an electrothermal converting element.

FIG. 10A is a plan view thereof; and FIG. 10B is a cross-sectional view, taken along line 10B—10B in FIG. 10A.

DETAILED DESCRIPTION OF THE PREFERRED EMBODIMENTS

Now, with reference to the accompanying drawings, the detailed description will be made of the embodiments in accordance with the present invention. Here, for the description, the same reference marks are applied to the parts having the same function in each of the embodiments given below.

(First Embodiment)

Figure 1:
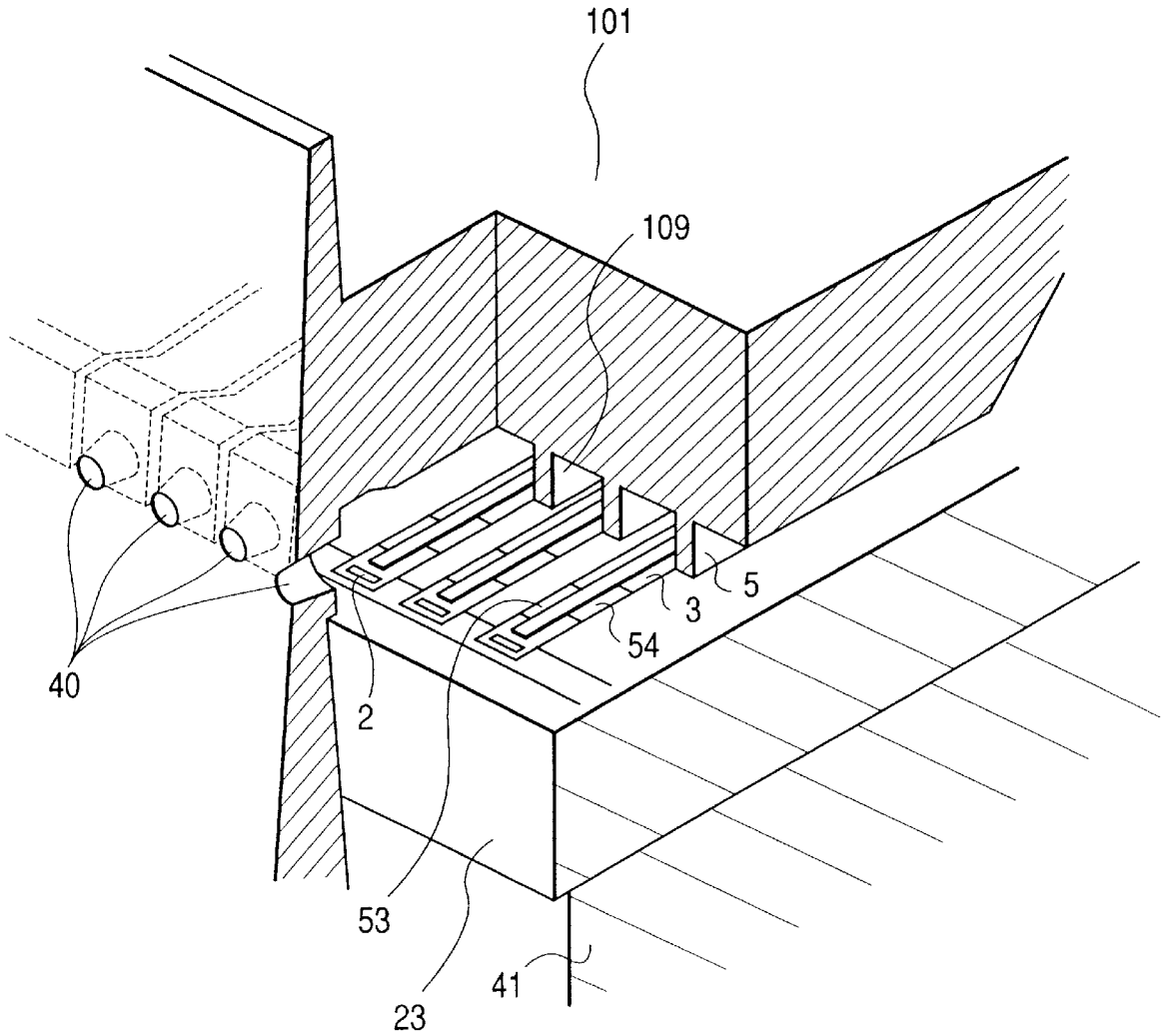
FIG. 1 is a perspective view which shows the circumference of nozzles of an ink jet recording head in accordance with a first embodiment of the present invention.

FIG. 1 is a perspective view which shows the circumference of nozzles of an ink jet recording head in accordance with a first embodiment of the present invention. This structure is called the edge shooter type where the electrothermal converting elements 53 and 54 are heated to cause ink to foam in the discharge nozzle 109, and then, ink is discharged from the orifice 40 which is open in the side direction.

Each of the electrothermal converting elements is connected with the common wiring (not shown) underneath the interlayer insulation film of the lower layer by way of the through hole 2. Then, voltage is applied to it by way of this common wiring. The wires provided for the electrothermal converting elements 53 and 54 are connected, respectively, with the switching transistors (not shown) which reside underneath the interlayer insulation film of the lower layer. Also, signal wires are connected with the transistors and the shift registers shown in FIG. 8 in order to make the on-off control of the transistors.

Also, the substrate 23 is bonded to the base plate 41, and the nozzle walls 5 are arranged for the ceiling plate 101. The end portion of the nozzle formed by the nozzle walls and the substrate on the upstream side (the end portion opposite to the discharge port side) is arranged to be a common liquid chamber. Liquid is supplied to this common liquid chamber by ink supply means (an ink tank or the like), which is not shown.

Figure 2A:
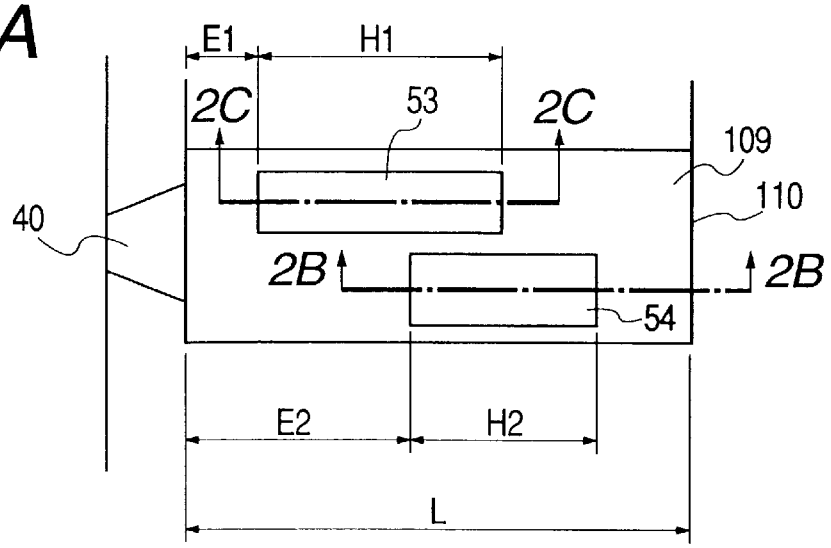
FIGS. 2A, 2B and 2C are views which illustrate the ink jet recording head in accordance with the first embodiment of the present invention.
Figure 2B:
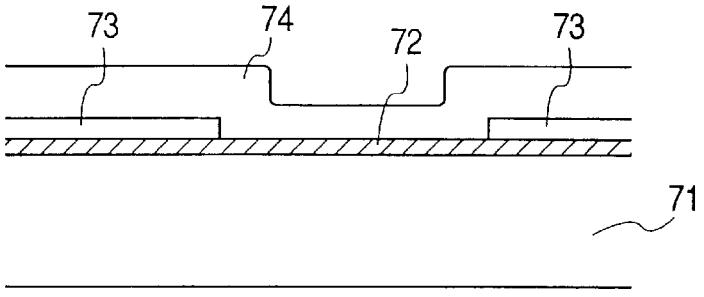
Figure 2C:
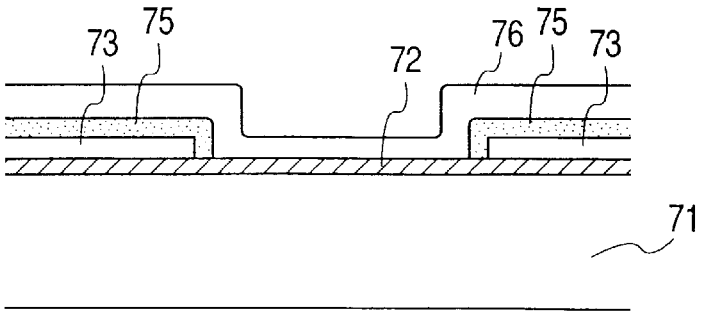

FIGS. 2A to 2C are views which illustrate the ink jet recording head in accordance with the first embodiment of the present invention; FIG. 2A is a detailed view of a nozzle; FIG. 2B is a cross-sectional view of an electrothermal converting element, taken along line 2B—2B in FIG. 2A; and FIG. 2C is a cross-sectional view of an electrothermal converting element, taken along line 2C—2C in FIG. 2A. In FIG. 2A, two electrothermal converting elements, that is, an electrothermal converting element 53 and an electrothermal converting element 54, are arranged in the discharge nozzle 109. Here, a reference numeral 110 designates the rear end of the nozzle 109, and the length L of the nozzle is 300 $\mu$m. At the leading end of the nozzle 109, the orifice 40 is arranged.

Also, in FIG. 2A, the length H1 of the electrothermal converting element 53 is 120 $\mu$m. The length H2 of the electrothermal converting element 54 is 90 $\mu$m. Then, given the distances from the rear end of the orifice 40 to the electrothermal converting elements 53 and 54 as E1 and E2, respectively, E1=80 $\mu$m and E2=150 $\mu$m in accordance with the present embodiment. In this manner, the recording head of the present invention is such that the length H2 of the electrothermal converting element 54 of the two, which is farther away from the discharge port in the ink discharge direction, is shorter than the length H1 of the electrothermal converting element 53, which is nearer to the discharge port in the ink discharge direction.

At first, with reference to the schematic views shown in FIGS. 3A and 3B, the description will be made briefly of the gradation control by use of the head described above. In this respect, the composition of ink used for each of the embodiments given below is as follows; however, the present invention is not necessarily limited to the use of this ink for obtaining its effects:

| | |
|---|---|
| Water | 82.8% |
| Glycerol | 5.0% |
| Ethylene glycol | 5.0% |
| Urea | 5.0% |
| Dye (direct black 195) | 2.2% |

Figure 3A:
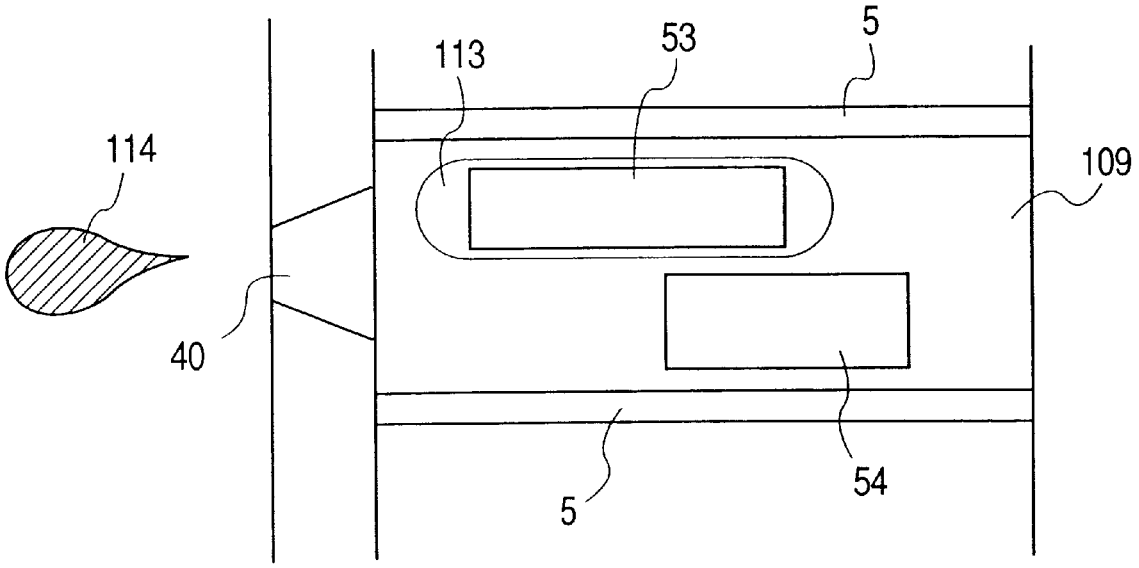
FIGS. 3A and 3B are views which illustrate the foaming state of the ink jet recording head in accordance with the first embodiment of the present invention.
Figure 3B:
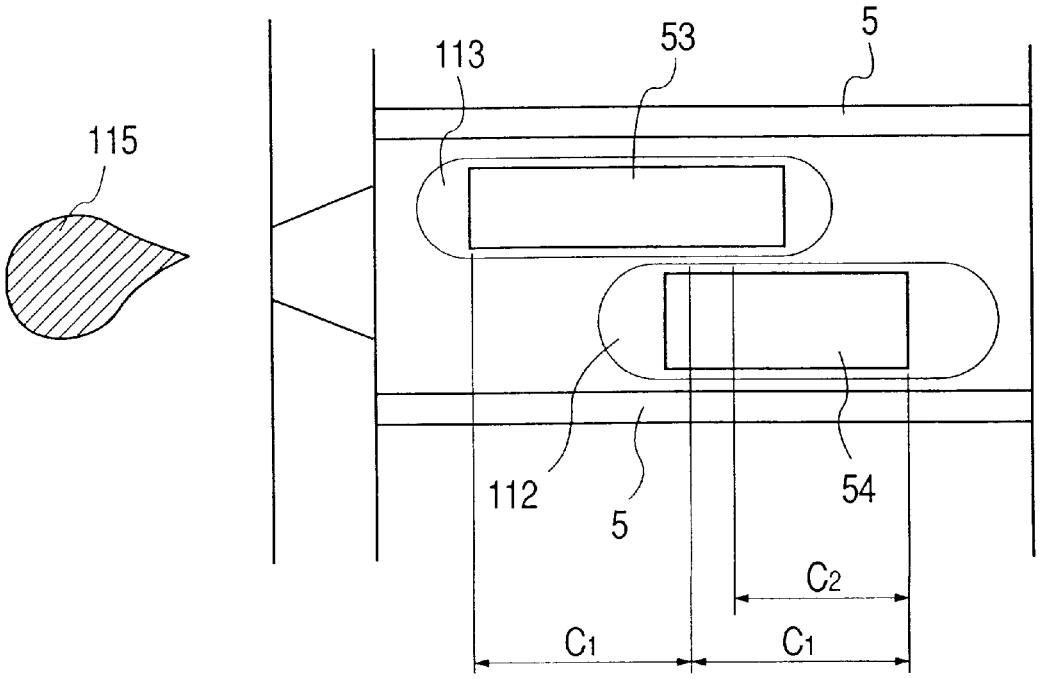

In FIG. 3A, the discharge nozzle 109, which is surrounded by the nozzle walls 5, is filled with ink. The electrothermal converting element 53 and the electrothermal converting element 54 are arranged in the nozzle 109. Here, when driving signal is given to the electrothermal converting element 53 to heat it, pressure is exerted by the foamed bubble 113 as shown in FIG. 3A. Then, a small liquid droplet (smaller drop) 114 is discharged from the orifice 40. In this case, the discharge amount is approximately 30 ng, and the discharge speed is 12 m/s. FIG. 3B shows the state that both of the electrothermal converting elements 53 and 54 are heated together to discharge a large liquid droplet (larger drop) 113. When the electrothermal converting element 53 is heated, the foamed bubble 113 is created. Then, when the electrothermal converting element 54 is heated, the foamed bubble 112 is created. Thus, by means of these two foaming, the larger droplet 115 is discharged. In this case, the discharge amount is 80 ng, and the discharge speed is 16 m/s. In this manner, the recording head of the present invention makes it possible to enhance the gradation by making the amount of the smaller droplet is as small as possible against that of the larger droplet (more specifically, the amount of larger droplet/the amount of smaller droplet$\geqq$2). In accordance with the present embodiment, the area ratio of the two heaters are almost 1:1.

On the observation of the foaming that may enable a larger droplet of the kind to be discharged, the center of the foaming should be positioned on the center of gravity of the electrothermal converting element. Here, in this particular case, the two electrothermal converting elements are assumed to function as one electrothermal device for convenience' sake. Therefore, the distance C2 from the rear edge of the electrothermal converting element 54, which is farther away from the discharge port, to the foaming center of the larger droplet becomes shorter than the distance C1 which is from the rear edge of the electrothermal converting element 54, which is farther away from the discharge port, to the center between the front edge of the electrothermal converting element 53, which is nearer to the discharge port, and the rear edge of the electrothermal converting element 54, which is farther away from the discharge port. In other words, the foaming center can be moved further backward (to the side opposite to the orifice) in this particular case.

Figure 4A:
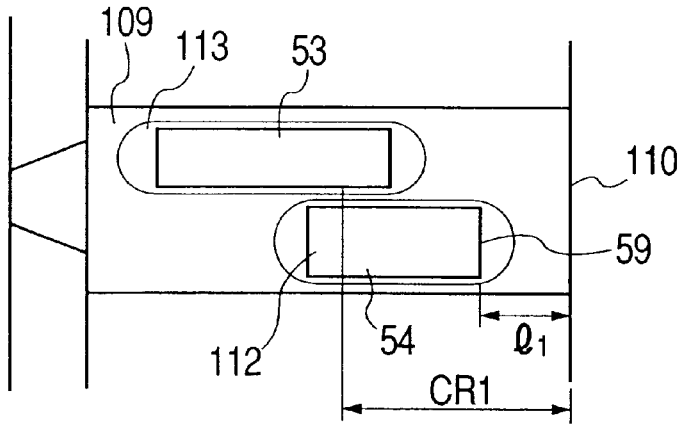
FIGS. 4A, 4B and 4C are views which schematically illustrate the comparison between the foaming state of larger droplet in accordance with the first embodiment of the present invention and that of the comparison example.
Figure 4B:
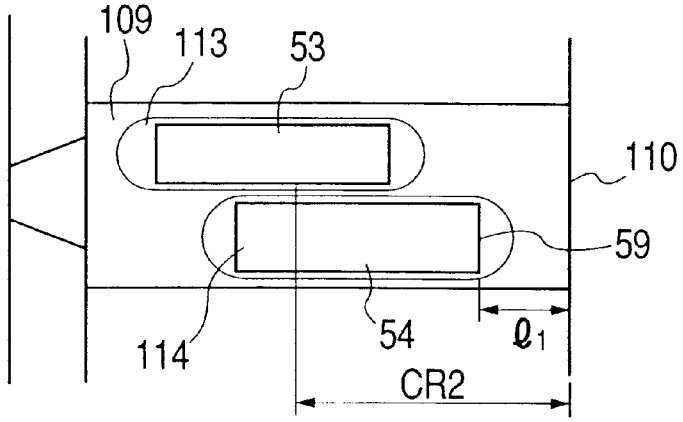
Figure 4C:
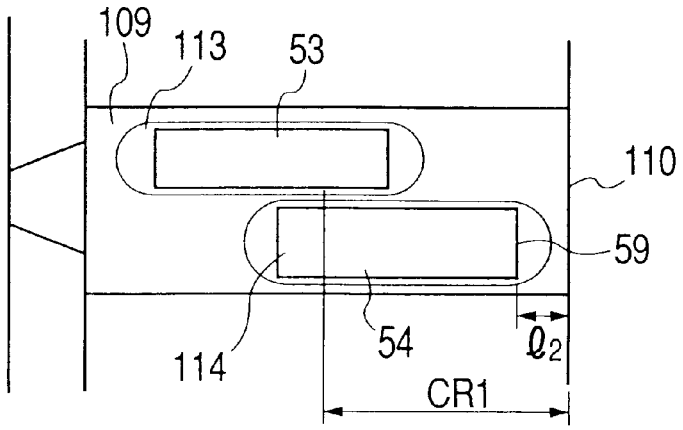

Now, by use of the comparison example, the description will be made of the foaming center of the larger droplet, in which the present invention is characterized. FIGS. 4A to 4C are views which schematically illustrate the comparison between the foaming state of larger droplet in accordance with the first embodiment of the present invention and that of the comparison example; FIG. 4A illustrates the foaming state of the first embodiment; FIG. 4B and FIG. 4C illustrate that of the comparison example.

The area of the electrothermal converting element 53 shown in FIGS. 4A to 4C is all the same, and the length thereof is H1. Also, the distance from the front edge of the electrothermal converting element 53 (discharge port side) to the discharge port (at E1 in FIG. 2A), and the nozzle length (at L in FIG. 2A) are all the same for each of the recording heads shown in FIGS. 4A to 4C.

When the electrothermal converting elements 54 and 53 in the discharge nozzle 54 of the head shown in FIG. 4A are heated by applying driving signals to each of them, the foamed bubbles 112 and 113 are created. In this case, the distance CR1 between the foaming center of the foamed bubble of the larger droplet and the rear edge of the nozzle 110 becomes approximately 130 $\mu$m. The refilling time is approximately 83 $\mu$sec. This is equivalent to approximately 12 kHz if it is converted into the driving frequency. Then, the distance 11 between the rear edge 59 of the electrothermal converting element 54 and the end portion of the common liquid chamber of the nozzle is 60 $\mu$m.

In contrast, the comparison example 1 shown in FIG. 4B is arranged so that against the first embodiment of the present invention, the length of the electrothermal converting element 54, which is father away from the discharge port, is made equal to the length of the electrothermal converting element 53, while keeping its area as it is, and at the same time, the distance (at E2 in FIG. 2A) from the front edge (discharge port side) of the electrothermal converting element 54 to the discharge port is shortened so as to make the distance 11 between the rear edge 59 of the electrothermal converting element 54 and the end portion of the common liquid chamber of the nozzle equal to that of the first embodiment.

When driving signals are applied to the electrothermal converting elements 53 and 54 in the nozzle 109 of the head of the comparison example 1 to create the foamed bubbles 113 and 114, the foaming center of the combined droplet is on the center between the front edge of the electrothermal converting element 52, which is nearer to the discharge port, and the rear edge of the electrothermal converting element 54, which is farther away from the discharge port, because the lengths and widths of the electrothermal converting elements 53 and 54 are the same. Then, as described above, the distance CR2 between the foaming center of the foamed bubble of the large droplet and the rear edge 110 of the nozzle 109 becomes approximately 140 $\mu$m. As a result, the refilling time is 100 $\mu$sec, which is 10 kHz as converted into the driving frequency.

The printing characteristics of the two heads representing the first embodiment and the comparison example 1 are examined by changing the driving frequencies. Then, the following results are obtained:

| Driving Frequency (kHz) | Embodiment 1 | Comparison Example 1 |
|---|---|---|
| 4 | good | good |
| 6 | good | good |
| 8 | good | good |
| 10 | good | almost good |
| 12 | almost good | conspicuous satellite |

As clear from this table, up to approximately 10 kHz, the head of the comparison example 1 shows almost the normal result of printing, but at 12 kHz, the satellite becomes conspicuous. The satellite is created if the ink refilling is not made in time. In other words, since the next foaming takes place before the meniscus surface of ink has returned to the initial static state, such discharge presents its exploded condition slightly, thus droplet being caused to impact on a medium in irregular condition. The quality of prints is degraded eventually. In contrast, the head of the present invention can execute its refilling in time, producing a good printing result. With the head of the present invention, it also becomes possible to implement the higher gradation and higher image quality at still higher speeds simultaneously.

On the other hand, the comparison example 2 shown in FIG. 4C is arranged in such a manner that against the first embodiment of the present invention, the length of the electrothermal converting element 54, which is father away from the discharge port, is made equal to that of the electrothermal converting element 53, while its area is left intact, and at the same time, the distance 12 between the rear edge 59 of the electrothermal converting element 54 and the end portion of the nozzle on the common liquid chamber side is to be 40 $\mu$m, which is shorter than the distance 11.

When driving signals are applied to the electrothermal converting elements 53 and 54 in the nozzle 109 of the head of the comparison example 2 to create the foamed bubbles 113 and 114, the foaming center of the combined droplet is on the center between the front edge of the electrothermal converting element 52, which is nearer to the discharge port, and the rear edge of the electrothermal converting element 54, which is farther away from the discharge port as in the case of the comparison example 1. Then, as described above, the distance CR2 between the foaming center of the foamed bubble of the larger droplet and the rear edge 110 of the nozzle 109 is made equal.

Then, printing characteristics of the first embodiment and the comparison example 2 are examined by changing the driving frequencies. The following results are obtained:

| Driving Frequency (kHz) | Embodiment 1 | Comparison Example 2 |
|---|---|---|
| 4 | good | good |
| 6 | good | good |

-continued

| Driving Frequency (kHz) | Embodiment 1 | Comparison Example 2 |
|---|---|---|
| 8 | good | discharge slightly disabled |
| 10 | good | discharge slightly disabled |
| 12 | almost good | a number of disabled discharges |

For the comparison example 2, the distance between the rear edge of the nozzle and the foaming center is the same as that of the embodiment 1. However, as the driving frequency becomes higher, the nozzles having disabled discharges begin to take place, and at 12 kHz, a number of disabled discharges are noticed. This is because the distance 12 is shorter than the distance 11 of the embodiment 1 so that the bubble created by the electrothermal converting element 54 is caused to reside beyond the rear edge of the nozzle when foamed bubble itself becomes larger due to the temperature rise of the head along with the increased driving frequency. This condition brings about a significantly delayed refilling. Then, it is conceivable that if the electrothermal converting element is energized for the next foaming in such condition, the disabled discharges may be caused eventually.

On the other hand, in accordance with the head of the present invention, the foaming center of the larger droplet is made shiftable to the common liquid chamber side (the side father away from the discharge port) when the larger droplet is discharged, while keeping a specific gap so that the bubble created by the electrothermal converting element, which is farther away from the discharge port, is not allowed to reside beyond the rear edge of the nozzle. In this way, the refilling time is made shorter, and with the stabilized discharges, the higher gradation and higher image quality can be obtained at the same time.

Now, with the recording head of the present invention, it is possible to obtain the higher gradation and higher image quality at higher speeds. In general, however, the minimum applicable voltage required for discharges is made different if the length of the electrothermal converting element is made larger in the direction of ink supply. It is then required for the recording apparatus to provide plural kinds of printing circuits, and the apparatus itself should become complicated to that extent inevitably.

Therefore, the recording head of the present invention is particularly arranged to enable the minimum applicable voltage to be set in accordance with the foaming requirement. Now, with reference to FIGS. 2B and 2C, such structural arrangement will be described.

FIG. 2B is a cross-sectional view of an electrothermal converting element, taken along line 2B—2B in FIG. 2A. FIG. 2C is a cross-sectional view of the electrothermal converting element, taken along line 2C—2C in FIG. 2A. A reference numeral 71 in FIG. 2B designates the silicon substrate having the heat accumulation layer formed thereon. There are formed on it, the resistance layer 72 formed by resistance material such as $HfB_2$, the wiring layer 73 formed by AL, and the protection film layer 74 formed by $SiO_2$ or some other insulation material (in a thickness of 1.3 $\mu$m), among some others. A reference numeral 71 in FIG. 2C designates the silicon substrate having the heat accumulation layer formed thereon. There are formed on it, the resistance layer 72 formed by resistance material such as $HfB_2$, the wiring layer 73 formed by AL, and the protection film lower layer 75 formed by PSG or some other insulation material (in a thickness of 0.6 $\mu$m), and the protection film upper layer 76 formed by $SiO_2$ or some other insulation material (in a thickness of 0.7 $\mu$m), among some others. The thin film formation is made in the corresponding step of manufacture only on the portion of the electrothermal converting elements by etching only such portion subsequent to having patterned the lower layer 75 of the protection film.

Then, in accordance with the first embodiment, the thickness of the protection film of the electrothermal converting element 54, which is father away from the orifice, is made larger than that of the other electrothermal converting element 53. In this manner, the efficiency of thermal energy transfer to ink becomes better for the electrothermal converting element 53 having the thinner protection film than the other electrothermal converting element 54. Thus, unlike the case where the thickness of the protection film is the same as that of the electrothermal converting element 54, it becomes possible to effectuate foaming at a lower voltage. Therefore, by selecting the thickness of the film appropriately in accordance with the difference in the length, the minimum applicable voltage is arranged to meet the foaming requirement. Thus, it is possible to solve the problems related to the cost increase, and the complicated structure of the apparatus main body due to the provision of plural kinds of circuits for voltage application.

Here, the electrothermal converting element 54 is driven only when the larger droplet is discharged, but the electrothermal converting element 53 is driven for discharging both the smaller and larger droplets. In accordance with the present invention, no protection film is provided for the electrothermal converting element 54. However, since the electrothermal converting element 54 is not used in very high frequency, there is no particular problem resulting from the temperature rise in its practical use.

(Second Embodiment)

Now, in conjunction with FIGS. 5A and 5B, and FIG. 6, the description will be made of a second embodiment of the present invention.

For the first embodiment described above, the thickness of the protection film is changed to make the length of the electrothermal converting element shorter, thereby to shorten the refilling time. After having studied and exercised utmost efforts, however, the inventors hereof have found that it is possible to make the length of the electrothermal converting element shorter, and then, to shorten the refilling time by changing the heat transferability of the protection film depending on the electrothermal converting elements.

Figure 5A:
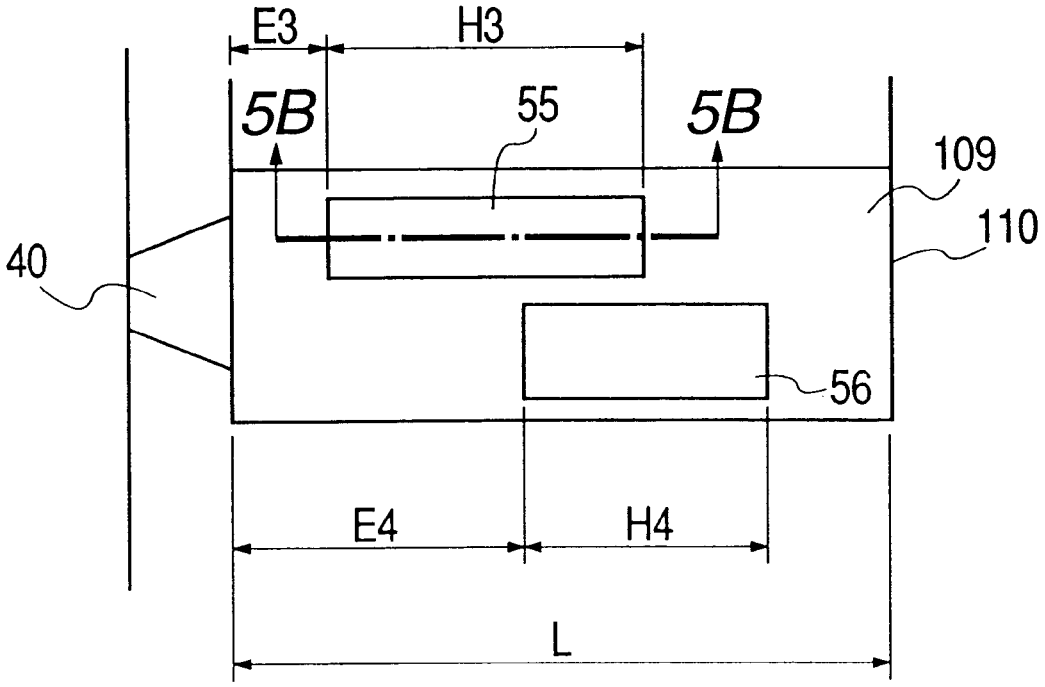
FIGS. 5A and 5B are views which illustrate an ink jet recording head in accordance with a second embodiment of the present invention.
Figure 5B:
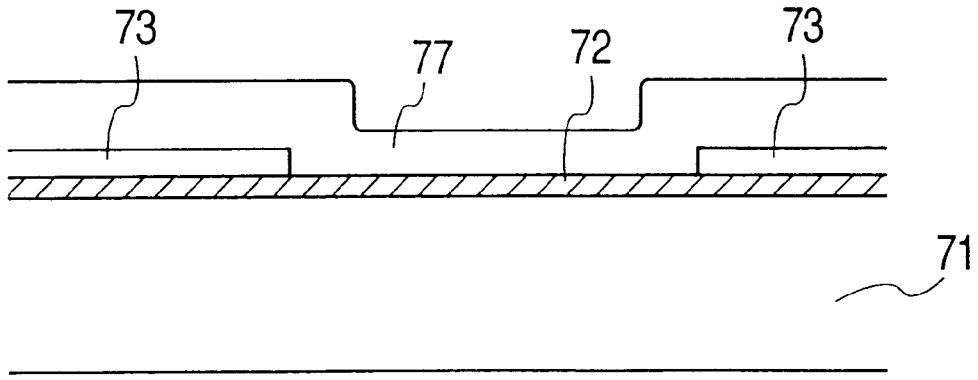

In FIG. 5A, two electrothermal converting elements 55 and 56 are arranged in the nozzle 109. Here, a reference numeral 110 designates the rear edge of the nozzle 109. The length L of the nozzle is 300 $\mu$m. At the leading end of the nozzle, the orifice 40 is arranged. Also, FIG. 5B is a cross-sectional view taken along line 5B—5B in FIG. 5A, in which a reference numeral 71 designates the silicon substrate having the heat accumulation layer formed thereon. There are arranged on it, the resistance layer 72 formed by $HfB_2$ or some other resistance material; the wiring layer 73 formed by Al, and the protection film layer 77 formed by $SiO_2$ or some other insulation material having high heat transferability, among some others.

In accordance with the present embodiment, the length H3 of the electrothermal converting element 55 is 120 $\mu$m. The length H4 of the electrothermal converting element 56 is 80 $\mu$m. Also, given the distances from the rear edge of the orifice 40 to the electrothermal converting elements 55 and 56 as E3 and E4, respectively, E3=80 $\mu$m, and E4=160 $\mu$m in accordance with the present embodiment.

Here, also, the heat transferability of the protection film of the electrothermal converting element 56 is made lower than that of the electrothermal converting element 55 in order to arrange the minimum applicable voltage to meet the foaming requirement. Therefore, the electrothermal converting element 56 has the lower efficiency of transferring heat to ink as compared with the case where it may use the same protection film as the one used for the electrothermal converting element 55, and a higher voltage is needed for this electrothermal converting element accordingly. Then, by selecting an appropriate thickness depending on the difference in lengths for the arrangement of the minimum applicable voltage to meet the foaming requirement, it becomes possible to solve the problems related to the cost increase, and the complicated structure of the apparatus main body due to the provision of plural kinds of circuits for voltage application.

Here, for the present embodiment, the use frequency of the electrothermal converting element 55 is lower than that of the electrothermal converting element 56, and the material having the lower heat transferability is used for it as in the first embodiment. Thus, there is no problem related to the temperature rise of the head in its practical use.

Figure 6:
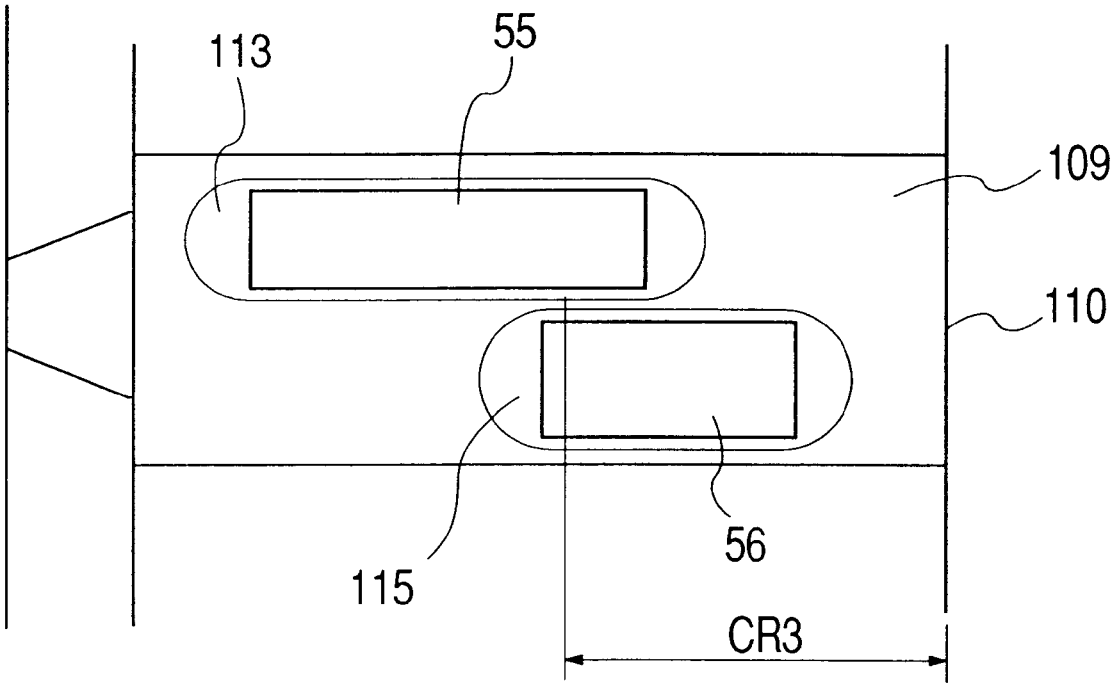
FIG. 6 is a view which illustrates the foaming state of a large droplet of an ink jet recording head in accordance with a second embodiment of the present invention.

FIG. 6 shows the foaming state of the large droplet being discharged under such structure as described above. When driving signals are applied to the electrothermal converting elements 56 and 55 to cause them to be heated, foamed bubbles 115 and 113 are created. The distance CR3 between the rear edge of the nozzle 109 to the center of foamed bubbles 115 and 113 is 120 $\mu$m. The refilling time is approximately 77 psec. Now, with the driving at 13 kHz, there is no problem of disabled discharges caused by the bubble of the electrothermal converting element 56 having been allowed to reside beyond the common liquid chamber side. Then, it is confirmed that the stabilized discharges are obtainable. Conceivably, this is because the distance between the rear edge of the electrothermal converting element, which is farther away from the discharge port, and the end portion of the nozzle on the common liquid chamber side is long enough as in the first embodiment.

(Third Embodiment)

Now, in conjunction with FIGS. 7A and 7B, the description will be made of a third embodiment in accordance with the present invention.

In accordance with the first and second embodiments described above, the electrothermal converting elements are arranged in parallel in the discharge direction. For the present embodiment, however, the devices are arranged in series. This is the aspect which differs from the previous embodiments. When the electrothermal converting elements are arranged in parallel, there is automatically a limit as to the density in which the nozzles can be arranged. As one of the methods for making the nozzle density higher, the electrothermal converting elements are arranged in series. It is still possible to shorten the refilling time also by making the length shorter in this particular arrangement for the electrothermal converting element, which is father away from the orifice.

Figure 7A:
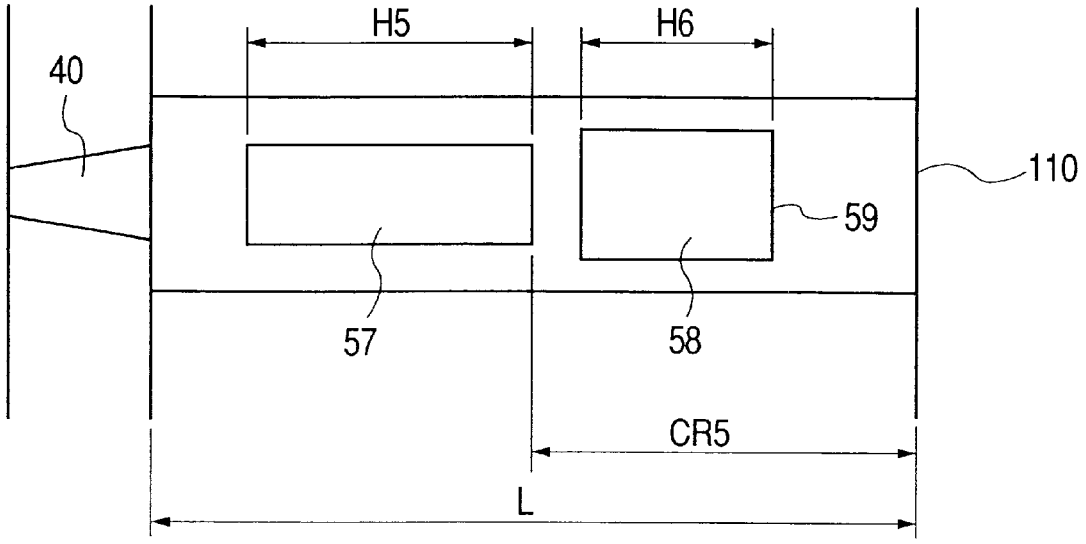
FIG. 7A is a detailed view which shows the nozzle of an ink jet recording head in accordance with a third embodiment of the present invention.
Figure 7B:
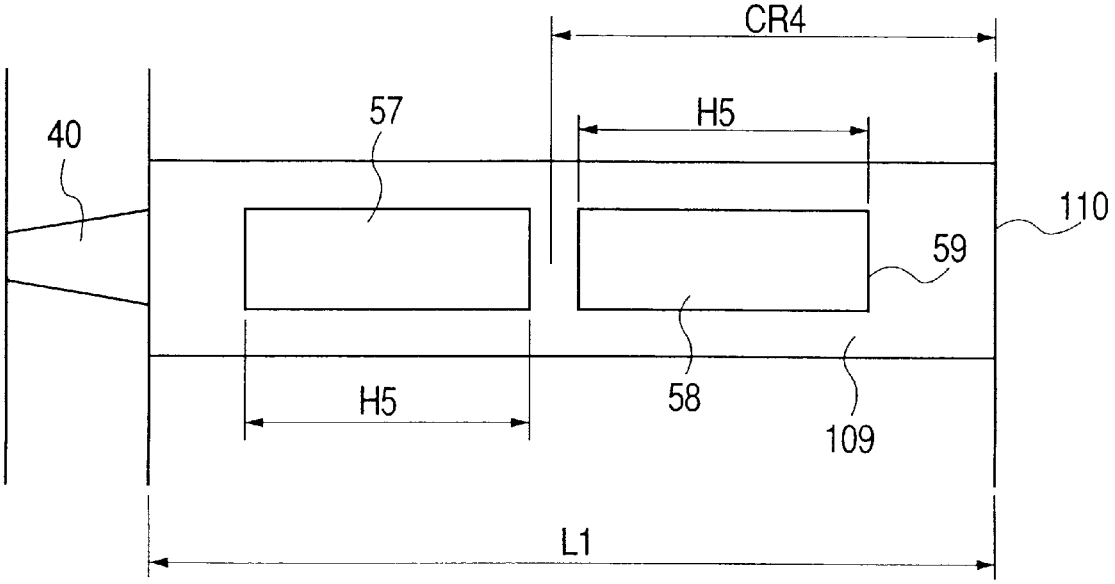
FIG. 7B is a detailed view which shows the nozzle of an ink jet recording head in accordance with the comparison example.

FIG. 7A is a detailed view which shows the nozzle of an ink jet recording head in accordance with the third embodiment of the present invention. FIG. 7B is a detailed view which shows the nozzle of an ink jet recording of the comparison example.

In FIG. 7A, two electrothermal converting elements 57 and 58 are arranged in the nozzle 109. Here, a reference numeral 110 designates the rear edge of the nozzle 109. The length L of the nozzle is 300 $\mu$m. At the leading end of the nozzle 109, the orifice 40 is arranged. In FIG. 7A, the length H5 of the electrothermal converting element 57 is 100 $\mu$m. The length H6 of the electrothermal converting element 58 is 60 $\mu$m. In this case, the distance CR5 between the foaming center of the larger droplet and the rear edge of the nozzle is approximately 130 $\mu$m.

In contrast, the comparison example 3 is prepared in such a manner that while the lengths of the electrothermal converting elements are arranged to be the same as those of the devices 58 and 57, and also, the distance between the rear edge of the electrothermal converting element 58 and the end portion of the nozzle on the common liquid chamber side is arranged to be the same as that of the third embodiment without changing the positional relationship of the electrothermal converting element 57 on the discharge port side. As a result, the discharge CR4 between the foaming center of the larger droplet and the rear end of the nozzle becomes larger than the distance CR5. Also, the length L1 of the nozzle becomes longer than the length L. Then, the printing examination is conducted as in the first embodiment described earlier, with the result that although both of them demonstrate good printing in the range of the lower driving frequency, the comparison example 3 shows conspicuous satellite in the high frequency driving range. The third embodiment still shows good printing results in such high frequency range.

As described above, it becomes possible for the present embodiment to print at higher speeds by making the refilling time shorter.

Here, in accordance with the present embodiment, either methods, which have been described for the first and second embodiments, are applicable to the arrangement of the minimum applicable voltage for each of the electrothermal converting elements. Also, it may be possible to combine them for the application. These arrangements may also be applicable to each of the previous embodiments.

Now, the embodiments of the principal parts of the present invention have been described. Hereunder, the description will be made of the other examples to which the present invention is applicable. In this respect, unless otherwise stated, each of the application examples given below is adoptable for any one of the embodiments of the present invention.

At first, the supplemental description will be made of the areas of the two electrothermal converting elements.

For each of the embodiments described above, the areas of the two electrothermal converting elements are substantially the same. However, in order to shift the foaming center of the larger droplet to the rear side of the center of the two electrothermal converting elements, it is desirable to arrange the area of the electrothermal converting element on the side farther away from the discharge port to be equal to or larger than that of the electrothermal converting element which is nearer to the discharge port. This is because when the gradation recording is performed by the smaller and larger droplets discharged by the two electrothermal converting elements, this arrangement may contribute to the enhancement of the actual gradation that requires the considerations of various aspects including the variation of discharges. This arrangement is also preferable particularly from the viewpoint of the higher gradation. In this respect, if the areas of the two electrothermal converting elements are the same, the foaming center of the larger droplet is on the middle point of the line segment that connects the respective gravities of the electrothermal converting elements themselves.

Now, the description will be made of a case where the recording head of the present invention is mounted on the conventional ink jet recording apparatus.

Depending on the design conditions, the recording head of the present invention does not demonstrate the recording characteristics genuine to it when it is mounted on the ink jet recording apparatus used for the convention recording head (where the gradation recording is not performed by use of the larger and smaller droplets), but it is still possible to perform recording by discharging larger droplets, and attain the same performance as the conventional recording head.

In this case, the new ink jet recording head should maintain the compatibility with the conventional recording head. Therefore, the new ink jet recording head is not allowed to dissipate electricity more than the conventional one. However, when one electrothermal converting element is divided into two, it becomes difficult to discharge droplet in the same size as it is discharged from one electrothermal converting element unless the combined area of the devices thus divided is made larger than the area of one device, because all the area of each of the electrothermal converting elements does not necessarily contribute to the foaming itself entirely. As a result, when two electrothermal converting elements are used, the power dissipation becomes greater eventually due to the arrangement needed to set the areas of the devices thus divided so as to make the amount of discharges equal to the one discharged from one electrothermal converting element. At the same time, depending on the arrangement of electrothermal converting elements, it becomes inevitable in some cases that these devices should be arranged in the positions which are not suitable for the performance of higher recording such as in the case of the comparison examples.

Now, however, with the application of the present invention, it becomes possible to provide a recording head capable of printing at higher speeds with the same power dissipation as the conventional one. In this case, in accordance with the nozzle configuration to be adopted and the like, the positions of the foaming center and electrothermal converting elements are set appropriately to implement the complete compatibility with the conventional head if the head of the present invention should be mounted on the conventional recording apparatus. At the same time, it becomes possible to implement the higher gradation and higher image quality at higher speeds if the head of the present invention is mounted on a recording apparatus that may preferably enable it to demonstrate its genuine performance.

In this way, the compatibility can be maintained anyway with the conventional recording heads. As a result, a large demand is anticipated for the new recording heads to make it possible to manufacture them on a large scale production. Then, it becomes possible to manufacture them at the production costs which can be reduced more than the costs that may be lowered just by a partial utilization of the manufacturing system currently in use, hence providing the new products at costs lower still.

Now, the description will be made of one example of the equivalent circuit capable of driving any one of the recording heads described in the above embodiments.

Figure 8:
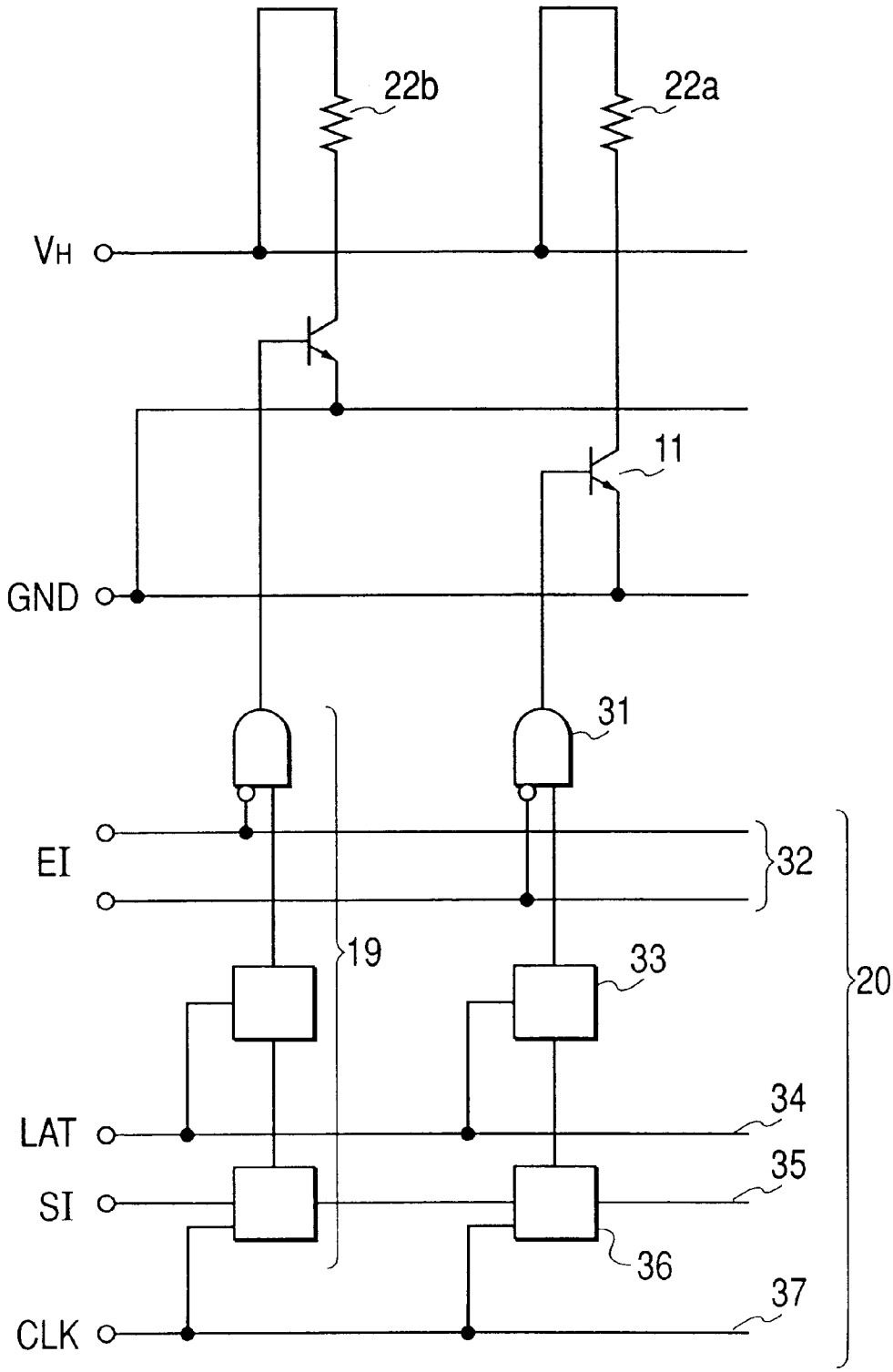
FIG. 8 is a perspective view which shows one example of the ink jet recording apparatus to which the present invention is applicable.

FIG. 8 illustrates one example of the equivalent circuit whereby to drive the ink jet recording head of the present invention. FIG. 8 shows the details of the shift register latch circuits 19 and 20 as described earlier. To the shift register 36, the CLK signal line 37 and the serial data line 35 are inputted, and the serial data are developed into the shift register 36 by clock signals. The data thus inputted into the shift register 36 are held in the latch 33 by the latch signals from the latch signal line 34. Then, the enable signal 32 is connected with the AND gate 31 to input printing timing at which to apply the data on the latch 33 to the transistor 11. There are two enable signals 32 so that the discharge heaters 22*a* and 22*b*can be driven at a time or at a deferred timing. It is possible to select the printing only by the discharge heater 22*a* or by both discharge heaters 22*a* and 22*b* with the actual selection of the discharges of the smaller droplet and the larger droplet by switching the aforesaid two enable signal lines.

Lastly, the description will be made of one example of the recording apparatus capable of mounting any one of the recording heads described in the respective embodiments.

Figure 9:
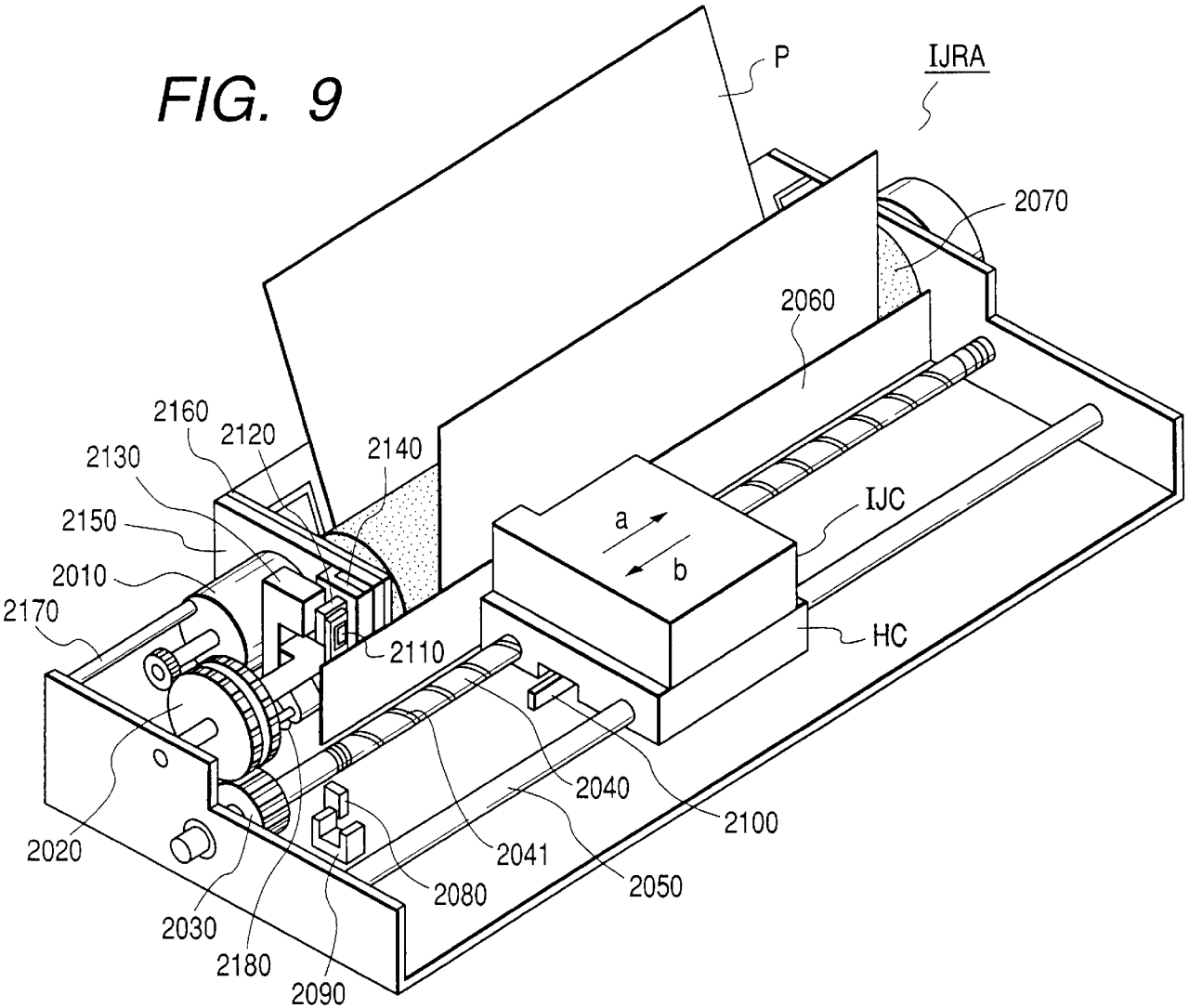
FIG. 9 is a view which illustrates one example of the equivalent circuit that can drive the ink jet recording head of the present invention.
Figure 10A:
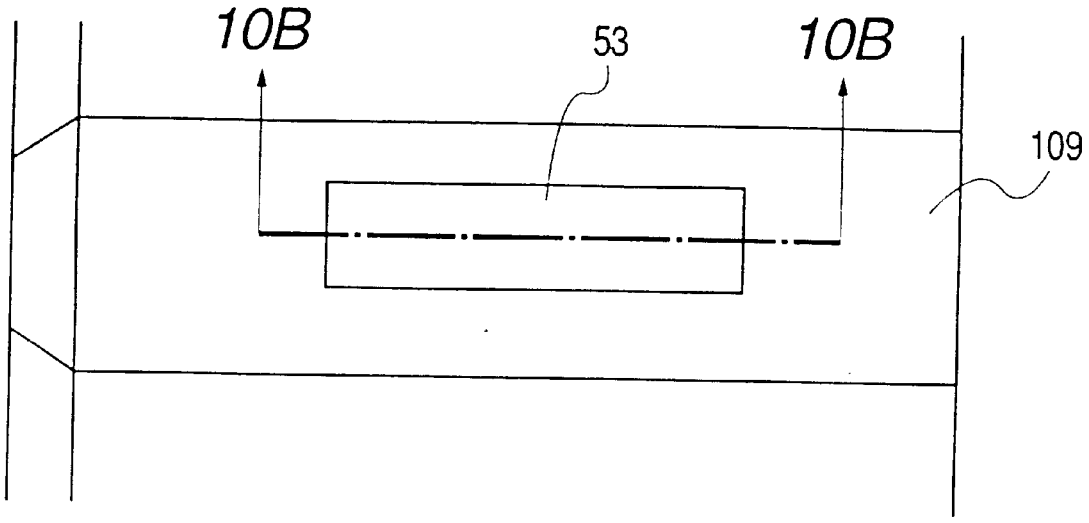
FIG. 10A PRIOR ART
FIGS. 10A and 10B are the detailed views of nozzle of the conventional ink jet recording head.
Figure 10B:
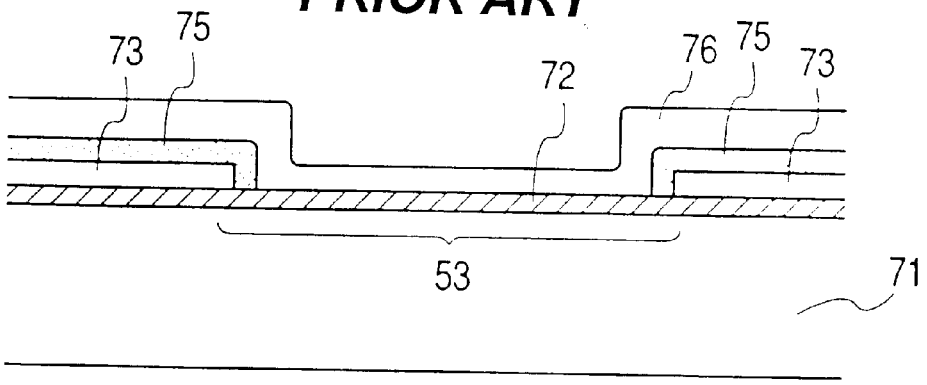
FIG. 10B PRIOR ART

FIG. 9 shows one example of the external appearance of an ink jet recording apparatus which mounts the ink jet recording head of the present invention. This ink jet recording apparatus IJRA is provided with a lead screw 2040 interlocked with the regular and reverse rotation of a driving motor 2010, which rotates through the driving power transmission gears 2020 and 2030. The ink jet recording head of the present invention and an ink tank are integrally formed as an ink jet cartridge IJC. This cartridge is mounted on the carriage HC which is supported by the carriage shaft 2050 and the lead screw 2040. With the pin (not shown) of the carriage that fits into the spiral groove 2041 of the lead screw 2040, the carriage reciprocates in the directions indicated by arrows a and b along with the rotation of the lead screw 2040.

Here, when the ink jet recording head is mounted on the ink jet recording apparatus, the electric connection is made between them by means of an electric connector (not shown). Then, it is arranged that the recording head receives electric signals for foaming by the application of thermal energy from electric signal supply means (not shown) provided for the recording apparatus.

A reference numeral 2060 designates a paper pressure plate, which presses the paper sheet P to the platen roller 207 that forms recording medium carrier means in the direction in which the carriage moves; 2080 and 2090, a photocoupler, which operates as home position detecting means for switching over the rotational directions of the motor 2010 when this means senses the present of the lever 2100 of the carriage HC in this zone.

A reference numeral 2110 is a member that caps the entire surface of the recording head, which is supported by the supporting member 2120, and 2130, means for absorbing the interior of the cap to execute the suction recovery of the recording head through the aperture provided for the interior of the cap. The cleaning blade 2140 that cleans the end face of the recording head is provided for the member 2150 that moves forward and backward. This member is supported on the main body supporting plate 2160. The blade 2140 is not necessarily limited to this configuration. It is needless to mention that any one of the known cleaning blades is applicable to this example.

Also, a reference numeral 2170 designates the lever which is used for recovering suction of the suction recovery, and which is movable along with the movement of the cam 2180 that engages with the carriage HC. With the movement of this lever, the driving power from the driving motor 2010 is controlled by known means of transmission, such as clutch switching. The structure is arranged so that each operation of these capping, cleaning, and suction recovery is performed as desired in the corresponding positions by the function of the lead screw 2040 when the carriage HC comes to the region on its home position side. To this example, any one of them is applicable if only the desired operation is arranged to be executable at known timing.

As described above, in accordance with the recording head of the present invention, the foaming center of the larger droplet (the gravitational position when the two electrothermal converting elements are made functional as one electrothermal converting element) can be positioned backward (on the upstream side in the ink supply direction) from the central portion of the electrothermal converting element when the two electrothermal converting elements are made to be functional as one large electrothermal converting element. Therefore, the foaming center can shift further backward (the side opposite to the orifice) to reduce the flow resistance on the rear side of the foaming center, hence making it easier to refill ink from the rear end portion of the nozzle, and to make the refilling time shorter accordingly. As a result, it is possible to implement the higher gradation and higher image quality at higher speeds.

Further, the recording head of the present invention can be manufactured by utilizing the conventional recording head manufacturing apparatus in order to implement the manufacture at lower costs. In addition, it is easy for the recording head of the present invention to maintain its compatibility with the conventional recording head. With the arrangement of the compatibility, a larger demand on the recording heads of the present invention is anticipated to make it possible to manufacture them on a large scale production, which contributes to the further reduction of production costs, thus providing the products at lower costs accordingly.

What is claimed is:

1. An ink jet recording head comprising:

a discharge port for discharging ink;

two electrothermal converting elements for generating thermal energy utilized for discharging said ink; and an ink flow path provided with said two electrothermal converting elements, at a same time, being conductively connected with said discharge port, wherein said ink jet recording head has a first discharge mode for discharging liquid droplets from said discharge port when the electrothermal converting element on a side nearer to the discharge port, of said two electrothermal converting elements, receives driving signals to generate said thermal energy, a second discharge mode for discharging liquid droplets from said discharge port in a larger discharge amount than that of said first mode when both of said two electrothermal converting elements receive driving signals to generate said thermal energy, and wherein of said two electrothermal converting elements, a length of said electrothermal converting element on a side farther away from said discharge port in an ink discharge direction is shorter than that of the other electrothermal converting element.

2. An ink jet recording head according to claim 1, wherein a minimum applicable voltages required for said two electrothermal converting elements to discharge said ink are substantially equal.

3. An ink jet recording head according to claim 2, wherein a thickness of a protection film of said electrothermal converting element farther away from the orifice is larger than that of the other electrothermal converting element.

4. An ink jet recording head according to claim 2, wherein a heat transferability of a protection film of said electrothermal converting element farther away from the orifice is lower than that of the other electrothermal converting element.

5. An ink jet recording head according to claim 1, wherein the area of said electrothermal converting element farther away from said discharge port is larger than the area of the other electrothermal converting element.

6. An ink jet recording head according to claim 1, wherein said two electrothermal converting elements are arranged in parallel in said ink flow path with respect to the ink discharge direction.

7. An ink jet recording head according to claim 1, wherein said two electrothermal converting elements are arranged in series in said ink flow path with respect to the ink discharge direction.

8. An ink jet recording apparatus comprising:

an ink jet recording head provided with a discharge port for discharging ink; two electrothermal converting elements for generating thermal energy utilized for discharging said ink; and an ink flow path provided with said two electrothermal converting elements, at a same time, being conductively connected with said discharge port; and installation means for mounting said head, wherein said ink jet recording apparatus has a first discharge mode for discharging liquid droplets from said discharge port when the electrothermal converting element on a side nearer to the discharge port, of said two electrothermal converting elements, receives driving signals to generate said thermal energy, and a second discharge mode for discharging liquid droplets from said discharge port in a larger discharge amount than that of said first mode when both of said two electrothermal converting elements receive driving signals to generate said thermal energy, and wherein of said two electrothermal converting elements, a length of said electrothermal converting element on a side farther away from said discharge ports in an ink discharge direction being shorter than that of an other electrothermal converting element.

9. An ink jet recording apparatus according to claim 8, wherein the minimum applicable voltages required for said two electrothermal converting elements to discharge ink are substantially equal, and at the same time, means for supply electric signals is provided for generating said thermal energy.

* * * * *

UNITED STATES PATENT AND TRADEMARK OFFICE

CERTIFICATE OF CORRECTION

PATENT NO. : 6,179,411 B1
DATED : January 30, 2001
INVENTOR(S) : Hideo Saikawa et al.

It is certified that error appears in the above-identified patent and that said Letters Patent is hereby corrected as shown below:

Column 3,
Line 49, "tives" should read -- tive --.

Column 4,
Line 19, right margin should be closed; and
Line 20, left margin should be closed.

Column 7,
Line 48, "father" should read -- farther --.

Column 8,
Line 37, "father" should read -- farther --.

Column 9,
Line 31, "father" should read -- farther --.

Column 10,
Line 10, "father" should read -- farther --.

Column 14,
Line 3, "22*b*can" should read -- 22*b* can --.

Signed and Sealed this

Eighth Day of January, 2002

*Attest:*

*Attesting Officer*

JAMES E. ROGAN
*Director of the United States Patent and Trademark Office*